United States Patent [19]

Wilson

[11] 4,340,225

[45] Jul. 20, 1982

[54] GAME RACKET AND APPARATUS FOR ADJUSTING THE TENSION IN THE STRINGS OF A GAME RACKET

[76] Inventor: Craig R. Wilson, 9550 Ella Lee La., Apt. 2001, Houston, Harris County, Tex. 77063

[21] Appl. No.: 29,717

[22] Filed: Apr. 13, 1979

[51] Int. Cl.[3] ..... A63B 51/12

[52] U.S. Cl. ..... 273/73 E

[58] Field of Search ..... 273/73 R, 73 D, 73 E

[56] References Cited

U.S. PATENT DOCUMENTS

| | | | |
|---|---|---|---|
| 240,183 | 4/1881 | Richardson | 273/73 E |
| 840,467 | 1/1907 | Beard | 273/73 D |
| 1,140,282 | 5/1915 | Parsons | 273/73 E |
| 1,252,576 | 1/1918 | Hutchinson | 273/73 D |
| 1,542,177 | 6/1925 | Rose | 273/73 D |
| 1,559,986 | 11/1925 | Quick | 273/73 E |
| 1,621,746 | 3/1927 | Morten | 273/73 E |
| 2,059,917 | 11/1936 | Spencer | 273/73 D |
| 2,089,118 | 8/1937 | Fritsch | 273/73 E |
| 2,193,526 | 3/1940 | Aubert | 273/73 E |
| 3,239,224 | 3/1966 | Finn et al. | 273/73 D X |
| 3,884,467 | 5/1975 | Sommer | 273/73 D |
| 3,912,267 | 10/1975 | Lyon | 273/73 D |
| 4,013,290 | 3/1977 | Stevens | 273/73 E |

FOREIGN PATENT DOCUMENTS

| | | | |
|---|---|---|---|
| 5248 | of 1880 | United Kingdom | 273/73 D |
| 175571 | 2/1922 | United Kingdom | 273/73 E |
| 220103 | 8/1924 | United Kingdom | 273/73 E |
| 234021 | 5/1925 | United Kingdom | 273/73 E |
| 320183 | 10/1929 | United Kingdom | 273/73 E |

*Primary Examiner*—Richard J. Apley

*Attorney, Agent, or Firm*—Guy McClung; Ronald G. Bliss; Dudley R. Dobie, Jr.

[57] ABSTRACT

A game racket and apparatus for adjusting the tension in the strings of a game racket. The game racket has a frame which forms a head. A handle is connected to the frame. The frame has a series of holes around its circumference. String or wire is laced through the holes of the frame to form a striking surface. The tensioning apparatus includes a screw which is threadedly mounted in the frame so that the string or wire passes over the head of the screw. The screw extends through the frame. The screw has engaging means exposed to the interior of the frame. The tension in the string is adjusted by turning the screw by means of the engaging means. The head of the screw may have shallow notches for releasably holding the string and for calibrating the adjustment of tension on the string.

2 Claims, 4 Drawing Figures

GAME RACKET AND APPARATUS FOR ADJUSTING THE TENSION IN THE STRINGS OF A GAME RACKET

BACKGROUND OF THE INVENTION

1. Field of the Invention

The present invention relates to game rackets and to an improved apparatus for adjusting the tension in the string or wire forming the striking surface of a game racket.

2. Description of Prior Art

Numerous attempts have been made to provide a game racket and apparatus for tensioning the strings of the racket. The disclosure of such devices is found in the following U.S. Pat. Nos. 3,912,267; 3,884,467; 3,239,224; 2,193,526; 2,089,118; 2,059,917; 1,621,746; 1,559;986; 1,542,177; 1,252,576; 1,140,282; 840,467; 240,183. Also, British Pat. No. 320,183 discloses a method for adjusting the tension on the strings. Generally, these patents disclose complex and cumbersome devices which provide inefficient and inaccurate string tensioning.

SUMMARY OF THE INVENTION

The present invention is directed to a game racket and an apparatus for tensioning the strings or wires that form the striking surface of the racket. The present invention provides an apparatus for tensioning strings that is easily accessible, adjustable, and accurate. The racket of this invention has a frame which forms a head and a handle connected to the frame. The frame has a series of holes. Strings or wire are passed through the holes and across the frame to form a striking surface. A plurality of tensioning means are provided between a plurality of pairs of the holes. The tensioning means is a screw which is threadedly mounted in and extends through the frame. Each screw has a head which is positioned on the exterior of the frame so that the string passes over the head. Each screw has an engaging means such as, but not limited to, a hexagonal bore which extends inwardly from the end of the screw at the interior edge of the frame. This bore is suitable for receiving an Allen wrench for turning the screw. As the screw is turned one way, tension in the string is increased; as the screw is turned the other way, tension in the string is reduced.

The heads of the screws which comprise the tensioning means may have at least one shallow notch formed integrally thereof for receiving and releasably holding the string. When the screw is turned, the string will shift of the notch thereby providing a means to calibrate the amount of adjustment and means to make an accurate adjustment. The quick and efficient tensioning means of the present invention eliminates the necessity for a player to have a variety of rackets, each tensioned for a different surface or different style of play. Also, the need for having a racket periodically re-strung due to reductions in tension is eliminated.

It is, therefore, an object of the present invention to provide an improved game racket.

Another object of the present invention is the provision of an improved apparatus for tensioning the string, wire, or line which makes up the striking surface of a game racket.

Yet another object of the present invention is the provision of such a tensioning means that is easily accessible, easily adjustable, and accurate.

A further object of the present invention is the provision of such an apparatus having means for calibrating the amount of adjustment of tension.

Another object of the present invention is the provision of a game racket having such a tensioning apparatus.

An additional object of the present invention is the provision of such a tensioning apparatus wherein the tensioning apparatus is a screw having a head, an interior hexagonal bore extending inwardly from the end of the screw opposite the head and suitable for receiving an Allen wrench for turning the screw.

A still further object of the present invention is the provision of a racket having at least one such tensioning apparatus mounted in the frame of the racket so that the string, wire or line making up the striking surface of the racket passes over the head of the screw so that when the screw is turned, the tension in the string, wire, or line is adjusted.

Another object of the present invention is the provision of such a racket which can be adjusted to accommodate a variety of surfaces and playing styles.

Yet another object of the present invention is the provision of such a racket which does not need to be completely re-strung when the string stretches.

Other and further objects, features and advantages will be apparent from the following description of the presently preferred embodiments of the invention, given for the purpose of disclosure, when taken in conjunction with the accompanying drawings.

BRIEF DESCRIPTION OF THE DRAWINGS

The invention will be more readily understood from a reading of the following specification and by reference to the accompanying drawings forming a part thereof, and wherein.

DESCRIPTION OF THE PREFERRED EMBODIMENTS

By way of illustration and not limitation, this detailed description presents two preferred embodiments of the present invention. It will be readily apparent to one skilled in this art that the present invention can be incorporated into many prior art devices.

Figure 1:
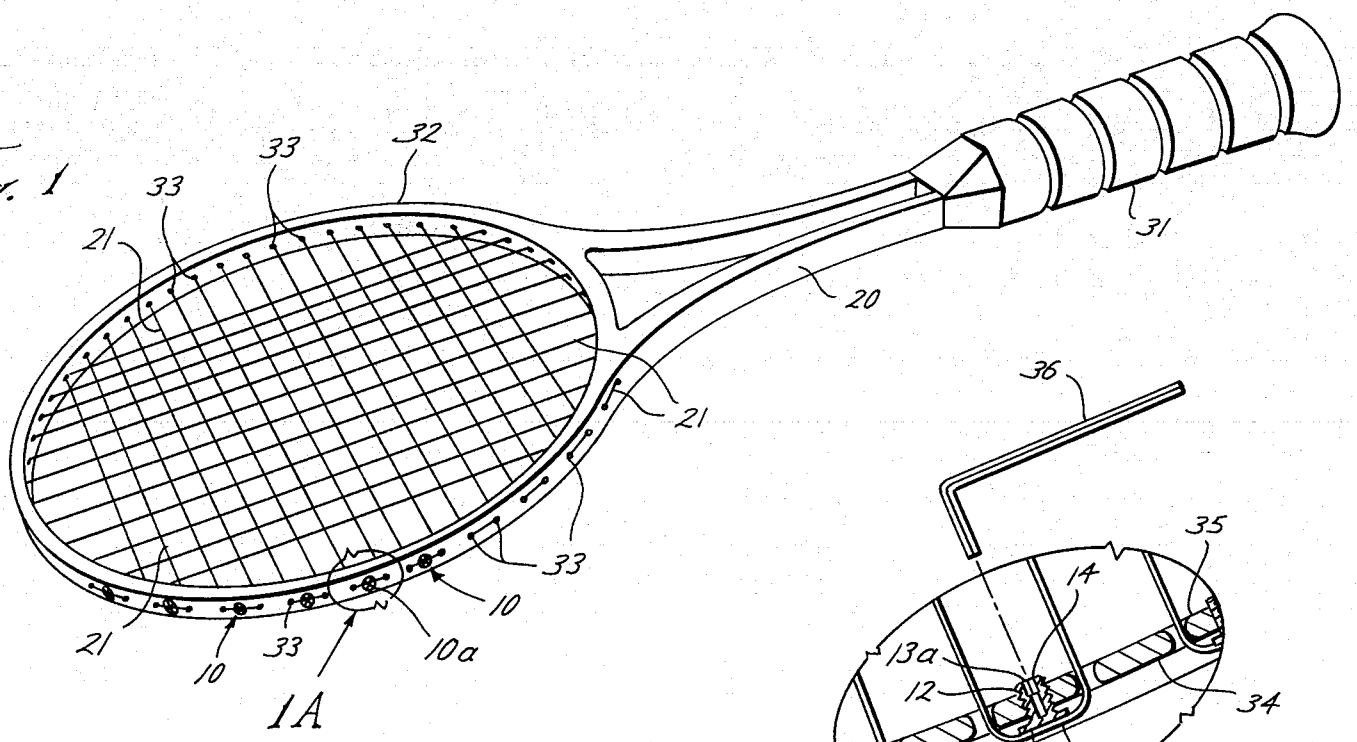
FIG. 1 is a perspective view illustrating a racket according to the present invention.

Referring now to FIG. 1, racket 20 has frame 32. Handle 31 is connected to frame 32. Frame 32 has a series of holes 33 through which extend strings 21. A plurality of tensioning means 10 are provided under a plurality of the strings 21. Each of the tensioning means 10 is positioned between a pair of the holes 33.

Figure 1A:
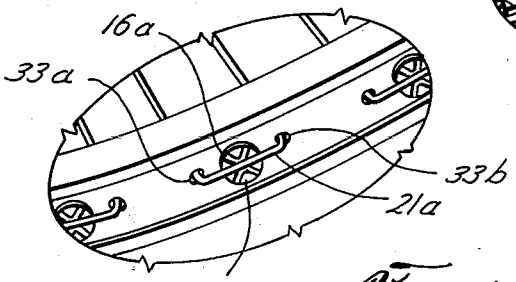
FIG. 1A is a perspective view of an enlarged exploded portion of the racket of FIG. 1.

Referring now to the exploded enlarged portion of FIG. 1A, the tensioning means **10*a* is positioned in the frame between the hole 33*a* and the hole 33*b* so that the string 21***a* passes over the head 16*a* of the tensioning screw 10*a*.

Figure 2:
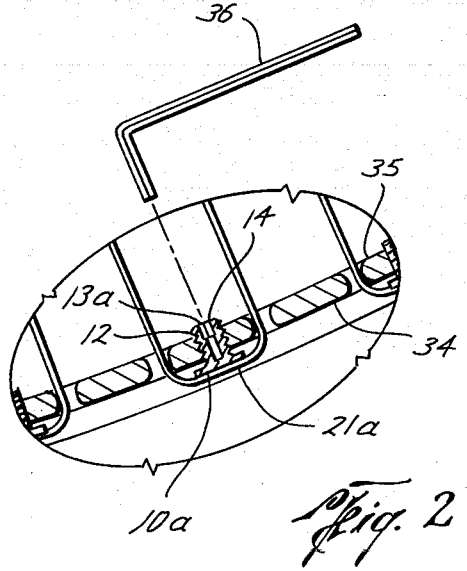
FIG. 2 is a cross-sectional view of the enlarged exploded portion of FIG. 1A with a perspective view of one embodiment of the tensioning apparatus according to the present invention.

Referring now to FIG. 2, the exploded enlarged portion of FIG. 1A is illustrated in cross section. The tensioning means 10*a* extends through the frame 32 of the racket 20. The head 16*a* of the tensioning screw 10*a* is on the exterior side 34 of the racket 20. The hexagonal interior bore 14 of the tensioning screw 10*a* extends inwardly from the end 13*a* of the tensioning screw 10*a*. The tensioning screw 10*a* extends through the interior side 35 of the frame 32 of the racket 20. The tensioning screw 10*a* has exterior threads 12 and it is threadedly mounted in the frame 32.

As shown in FIG. 2, the hexagonal bore 14 of the tensioning screw 10*a* is suitable for receiving the end of an Allen wrench 36. When the Allen wrench 36 is turned in one direction, the tension on the string 21*a* is increased. When the Allen wrench 36 is turned in the other direction, the tension on the string 21*a* is reduced.

Figure 3:
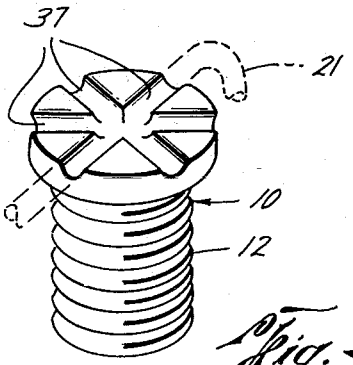
FIG. 3 is a cross-sectional view of another embodiment of the tensioning apparatus according to the present invention.

The tensioning screws 10 may be provided with one or with a plurality of shallow notches 37 in the head 16 as shown in FIG. 3. When the tensioning screws 10 are stationary, the strings 21 are positioned in one of the notches 37. When adjustment of the tension in the strings 21 is desired, as the tensioning screws 10 are turned, the strings 21 will shift from one notch to another. The notches 37 provide a means for calibrating the desired adjustment of tension so that an accurate adjustment is made.

The foregoing disclosure and description of the invention is illustrative and explanatory and various changes in the size, shape and materials, as well as in the details of the illustrated construction, may be made within the scope of the appended claims without departing from the spirit of the invention.

What is claimed is:

1. A racket having, a head comprising a closed frame having a plurality of coplanar holes therethrough at spaced intervals, a handle connected to the head, a string passing through the holes of the head and across the closed frame to form a striking surface, a plurality of tensioning screws, each screw positioned between a single pair of the coplanar holes of the closed frame, each tensioning screw having a head having at least one shallow notch extending thereacross for releasably holding the string and an engaging means exposed to the interior of the closed frame for turning the screw, and the string passing over and contacting the head of the screw so that turning the screw one way increases the tension on the string and turning it the other way decreases the tension on the string.

2. The racket of claim 1 wherein the engaging means comprises a hexagonal interior bore suitable for receiving an Allen wrench.

* * * * *